United States Patent [19]

Van Heeckeren

[11] Patent Number: 4,537,279

[45] Date of Patent: Aug. 27, 1985

[54] TUNEABLE TUNED PIPE EXHAUST SYSTEM

[76] Inventor: Walraven Van Heeckeren, Studio 11, 17 Herbert St., St. Leonards, N.S.W., 2065, Australia

[21] Appl. No.: 515,981

[22] Filed: Jul. 21, 1983

[30] Foreign Application Priority Data

Jul. 22, 1982 [AU] Australia ..... PF 4998

[51] Int. Cl.[3] ..... F01N 7/18

[52] U.S. Cl. ..... 181/241; 181/227

[58] Field of Search ..... 181/240, 227, 241, 264, 181/281, 239; 60/324, 272, 314

[56] References Cited

U.S. PATENT DOCUMENTS 3,870,083 3/1975 Nezat ..... 60/324

4,023,365 5/1977 Van Ginhoven ..... 60/324

4,341,283 7/1982 Mazzanti ..... 181/241

*Primary Examiner*—L. T. Hix

*Assistant Examiner*—Brian W. Brown

*Attorney, Agent, or Firm*—Stevens, Davis, Miller & Mosher

[57] ABSTRACT

A tuneable exhaust pipe for an internal combustion engine having a baffle slidable longitudinally within the exhaust pipe at the upstream end a plug in the downstream end. The baffle and plug each have an opening for passage of exhaust gasses therethrough. The baffle defines a resonate chamber on each side of it. The chambers avoid turbulence and maintain the shock wave in the gasses so that the chambers cause an additive dynamic relationship calculated to cause a supercharging effect on the engine by increasing the internal pressures therein.

6 Claims, 3 Drawing Figures

TUNEABLE TUNED PIPE EXHAUST SYSTEM

This invention relates to exhaust systems for internal combustion engines, and more particularly to a tuneable 'exhaust pipe' for a two-stroke internal combustion engine.

It is a comparatively simple procedure to 'tune' a four-stroke cycle engine, since, when the inlet port of a cylinder is open, its exhaust valve is closed. Hence, a so-called 'extractor' can be employed, which allows the exhaust gases' own inertia to sweep the said gases out through the tail pipe. When this happens, the low pressure region in the pipe is, in effect, drawing the exhaust gases out of the engine so that when the exhaust valve closes the cylinder is left under slight vacuum, and so that when the inlet valve opens, a large charge is drawn into the engine.

However, the situation is not so simple in the case of the two-stroke cycle because, when the exhaust port opens, the inlet port has not yet fully closed. The exhaust gases are ejected from the exhaust port by the residual pressure in the chamber, and inertia carries the wave down the exhaust pipe, creating a low pressure region behind it. As the piston travels downwardly, the inlet port opens to admit a fresh charge of fuel/air mixture, and this downward piston movement also creates pressure in the crankcase which causes the fresh charge to be injected into the combustion chamber.

Now, in conventional exhaust systems, the exhaust pipe is 'tuned' so that the high pressure wave is reflected back to the exhaust port just before the latter closes. By this time the inlet port has already closed so that the high pressure region pushes the excess charge in the pipe back into the combustion chamber to effectively supercharge the engine.

There is presently commercially available a wide range of tuned pipes but all suffer from the drawback of having a relatively narrow so-called 'power-band'. That is to say, an engine fitted with a conventional tuned pipe having only the usual narrow specific RPM range will lose power when its RPM falls outside this specific range. The functioning of a tuned pipe is effected with regard to the following parameters:

(a) the degree of supercharging is directly proportional to the pressure generated by the high pressure wave;

(b) changes in ambient temperature result in changes in the speed at which the pressure wave is propagated;

(c) the length of a tuned pipe has an inverse relationship to the velocity of the pressure wave;

(d) the length of a tuned pipe has an inverse relationship to the temperature of the exhaust gases in the pipe;

(e) the length of a tuned pipe has an inverse relationship to the RPM of the engine.

The end-result is that when such a device as a two-stroke motor-cycle for example, fitted with a conventional tuned pipe, is ridden uphill, the RPM drop off—out of the specific tuned-for range—and the engine "drop off the pipe", that is to say, the engine will behave as though the pipe doesn't exist, with resultant loss of supercharging effect and thus of power. Similarly, when RPM increase, as in downhill conditions, the engine will once again "drop off the pipe" but on the other side of the RPM-specific range.

It is therefore an object of the present invention to overcome the above and other disadvantages by the provision of tuneable means for the exhaust system of a two-stroke cycle internal combustion engine, comprising a baffle slidable longitudinally within an exhaust pipe of said system, a plug insertable in, or attachable to, the free, downstream end of said pipe, and means for selectively positioning said baffle within said pipe to thereby define an upstream primary chamber and a downstream secondary chamber; said baffle having a wave-reflecting upstream side and being provided with at least one conduit therethrough communicating said primary chamber with said secondary chamber, and said plug having a wave-reflecting upstream side and being provided with at least one conduit therethrough communicating said secondary chamber with atmosphere.

It is to be understood that the expression 'upstream' end or side refers to that end or side closest to the exhaust manifold, while 'downstream' end or side refers to that end or side closest to the discharge opening of the exhaust pipe.

The wave-reflecting upstream sides of the baffle and of the plug are ideally constituted by concavities of substantially conical configuration.

Preferably, the baffle positioning means includes an elongated rod, one end of which is affixed to the downstream side of the baffle and the other end of which is adapted to slide through a co-acting bore through the plug, the plug being provided with means to immobilise the elongated rod in the bore and thus to immobilise the baffle in a selected location within the exhaust pipe.

In order that the reader may gain a better understanding of the present invention, hereinafter will be descrbed certain preferred embodiments thereof, by way of example only, and with reference to the accompanying drawings in which.

Figure 1:
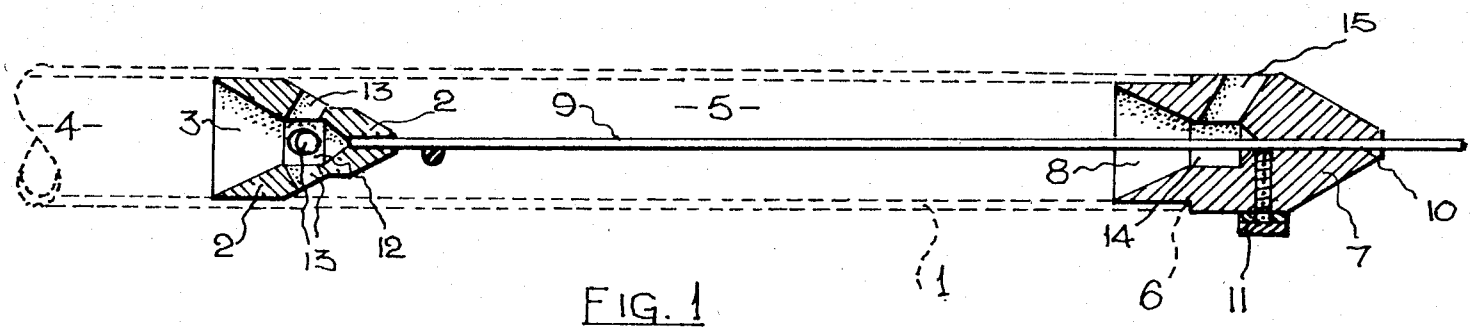
FIG. 1 shows, in longitudinal cross-section, a tuneable means according to the present invention.

Referring firstly to FIG. 1, an exhaust pipe of a two-stroke cycle internal combustion engine is shown in broken line and referenced 1. The length of the pipe is not critical and may well be in keeping with the nature of the device powered by the engine in question; however, the cross-sectional area of the pipe should be at least equal to that of the exhaust port of the engine.

Slidable longitudinally within pipe 1 is a baffle 2, the upstream side of which is adapted to reflect a pressure wave travelling down the exhaust pipe, this upstream side being constituted by a concavity 3 of substantially conical configuration. As will be appreciated, the existence of baffle 2 within pipe 1 defines a primary chamber 4 and, downstream of it, a secondary chamber 5.

Insertable into the free, downstream end 6 of pipe 1 is a plug 7 having a wave-reflecting upstream side, again constituted by a concavity 8 of substantially conical configuration.

Means are provided for the selective positioning of baffle 2 within pipe 1, such means comprising a rod 9—for example, a length of suitable wire—one end of which is affixed as shown into the downsteam side of the baffle 2. Rod 9 is adapted to slide through a bore 10 through the plug 7 and can be immobilised by a clamping arrangement such as the screw and locknut combination 11. The plug 7 may itself be secured in the end of the exhaust pipe by such means as a grub-screw, or it may merely be a tight push-fit therein. Thus, the baffle 2 may be selectively positioned in the exhaust pipe 1 so as to permit the relative volumes of the two chambers 4 and 5 to be varied.

The conic angle of the concavity 3 of the upstream side of baffle 2 is ideally 30° and its apex leads to a manifold chamber 12 from which radiates a number of passageways 13, these passageways being so inclined and located for a reason later to be explained herein. Together, concavity 3, chamber 12 and passageways 13 form a conduit by means of which the two chambers 4 and 5 are placed in communication one with the other.

The conic angle of the concavity 8 of the upstream side of the plug 7 is also ideally 30° and its apex leads to a chamber 14 from which leads at least one passageway, such as that referenced 15, later to be described. Concavity 8, chamber 14 and passageway 15 together constitute a conduit by means of which the secondary chamber 5 is enabled to be communicated with atmosphere. The total cross-sectional areas of the radiating passageways 13 of the baffle 2 are preferably in the region of $\frac{1}{4}$ the cross-sectional area of the exhaust port of the engine's manifold. The cross-sectional area of the passageway 15 of the plug 7 is most advantageously about 13% of the cross-sectional area of the engine's exhaust port.

The tuneable means of the present invention functions as follows:

The tuneable means is installed in the pipe of the exhaust system, or an exhaust pipe including such tuneable means is fitted to the exhaust system of a two-stroke cycle internal combustion engine. With the engine running sweetly per se, the slidable baffle 2 is positioned at an extreme downstream location, closely adjacent the end plug 7, and in this connection the rod 9 may be provided with a stop 16 to prevent baffle 2 from mating so closely with plug 7 that exhaust discharge is inhibited. This stop means or detent could, alternatively, be constituted by a 'kink' in the wire rod 9. The engine is then 'revved up' and the baffle slid upstreamedly in the exhaust pipe to a position in which maximum RPM are deemed to have been attained. The rod 9, and thus the baffle 2, is then clamped in the selected location by manipulation of the clamping arrangement 11.

What has happened is that the pulse or pressure wave coming from the engine is largely reflected by the wave-reflecting concavity 3 of baffle 2, and this occurence is the reason for the particular positioning and inclination of the passageways 13 in the baffle 2. To employ an apt expression, the pulse "does not see" these passageways until reflection has occurred, although the exhaust gases are nevertheless vented through passageways 13 into secondary chamber 5.

The exhaust gases travel downstream through the pipe and are eventually discharged to atmosphere through the passageway 15 in plug 7 while the wave is reflected from wave-reflecting face 8 of plug 7 back towards baffle 2. Meanwhile, a fresh pulse or pressure wave has emanated from the engine only to meet the reflected wave and to thereby generate a high amplitude pulse which travels back to the engine to give a very high supercharging effect indeed. Now, if the location, in the exhaust pipe, of baffle 2 is so arranged that the secondary chamber is of lesser volume than the primary chamber, the pulse will arrive at baffle 2 before the next pulse from the engine. The leading pulse will arrive back at the engine before the trailing pulse but just before the exhaust port closes, and the supercharging effect is maintained even through RPM increase.

Conversely, locating the baffle so that chamber 5 is of lesser volume than chamber 4, will cause the pulse to arrive back after the exhaust port opens. By judicious manipulation, a location can be arrived at where the engine can be maintained "on the pipe" for up to $\frac{2}{3}$ of the throttle travel—a very wide powerband indeed! Such a selected location of the baffle in the exhaust pipe might well be termed a 'median setting'. In other words, a region of overlap has been established.

Figure 2:
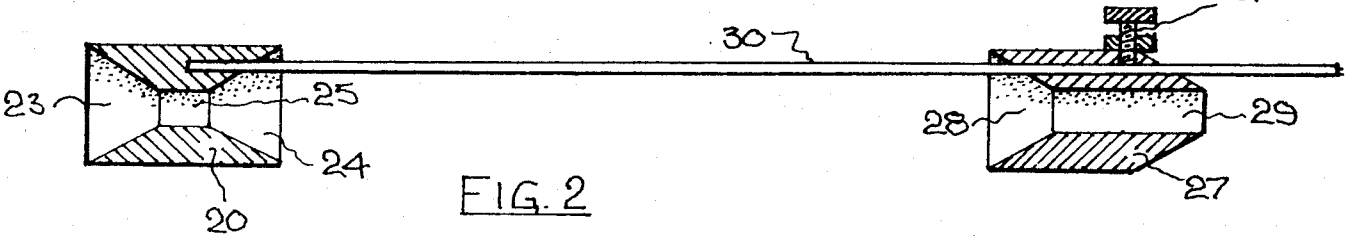
FIG. 2 illustrates a second embodiment.

FIG. 2 shows, again in longitudinal cross-section, a second, and rather simpler, embodiment of the present invention. In this embodiment, a slidable baffle 20 has dual wave-reflecting concavities 23 and 24 connected by a central chamber 25, and the end plug 27 has a wave-reflecting upstream side concavity 28 leading to a straight-through passageway 29 communicating the second chamber to atmosphere. The positioning means is again a wire 30, which is clampable by the screw arrangement 31 of the plug 27.

Figure 3:
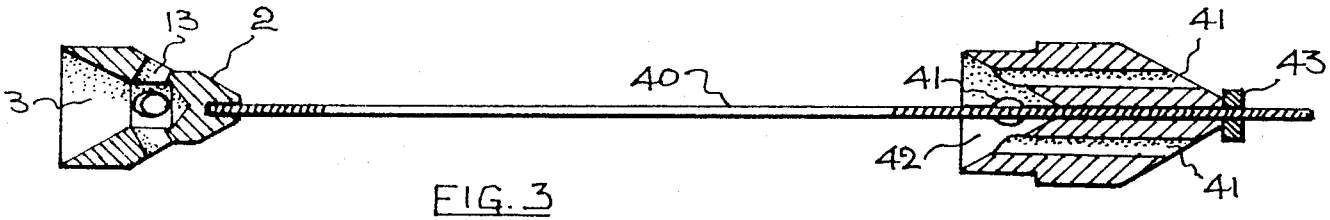
FIG. 3 shows a third embodiment.

In the variation illustrated in FIG. 3, the baffle is configured as the baffle 2 of FIG. 1 except that the wire rod 40 is now affixed to the downstream side of the baffle by being screwed into it as shown. In this embodiment, the rod does not slide through a bore in the end plug but is screwed thereinto, the end plug having passageways 41 by means of which the secondary chamber is placed in communication with atmosphere via an upstream-side concavity 42. Rod 40 can be immobilised in the plug by operation of the locknut 43.

The tuneable means according to the present invention may be supplied complete with the exhaust pipe, or it might well be manufactured to fit any standard parrallel-walled pipe. The flow characteristics, that is to say, the effects of turbulence, do not appear to be critical, and the baffle and plug components may be fabricated from a wide range of materials; thus, aluminium or aluminium alloys may be used, as may such other materials as stainless steel, ceramics, cermets or even high-temperature-resistant plastics.

The effect of the tuneable pipe means on a normal small engine of, say, a motor cycle which runs at about 14,000 RPM maximum is a gain of as much as 1000 RPM—representing a substantial increase in power of perhaps 5 to 10 bhp in a typical machine. In an actual test case, a tuneable pipe simply 'plugged' into the downsteam end of a muffler and tuned by the baffle added 700 RPM to the engine's maximum revs.

As it has been so far described, the movable baffle is longitudinally adjusted in an exhaust pipe to give optimum revs as determined 'by ear'. After clamping the wire, the protruding excess length may be cut off. In a more advanced arrangement, a servo-mechanism might well be employed to move the slidable baffle in response to changing conditions while the engine is running; that is to say, the servo-mechanism is actuated in the first place by the rider as he listens to the engine revs. However, most effective would be an electronic rev-counter or tachometer driving such a servo-mechanism to so move the baffle in response to changes in RPM.

As will be readily appreciated from the above-going, tuneable means for the exhaust system of a two-stroke cycle internal combustion engine according to the present invention will provide the public with a new or much improved product or, at the very least, offer to it a most useful and very attractive choice.

I claim:

1. Tuneable means for the exhaust system of a two-stroke cycle internal combustion engine, comprising a baffle slidable longitudinally within an exhaust pipe of said exhaust system; a plug insertable into the free, downsteam end of said exhaust pipe; and means for selectively positioning said baffle within said exhaust pipe to thereby define therein an upstream primary chamber and a downstream secondary chamber; said baffle having a wave-reflecting upstream side constituted by a concavity of substantially conical configuration, and being provided with at least one conduit therethrough communicating said primary chamber with said secondary chamber; said plug having a wave-reflecting upstream side constituted by a concavity of substantially conical configuration, and being provided with at least one conduit therethrough communicating said secondary chamber with atmosphere; and said baffle positioning means including an elongated rod, one end of which is affixed to the downstream side of said baffle and the other end of which is adapted to extend through a co-acting bore extending longitudinally through said plug, said plug being provided with means to immobilize said elongated rod in said bore to thereby immobilize said baffle at a selected location within said exhaust pipe.

2. Tuneable means as claimed in claim 1, wherein the apex of the substantially conical concavity of said baffle leads into a manifold chamber from which radiate a plurality of spaced passageways, each inclined towards said secondary chamber, which communicate said primary chamber with said secondary chamber; and wherein the apex of the substantially conical concavity of said plug leads into a chamber from which a passageway, inclined away from said secondary chamber, communicates said secondary chamber with atmosphere; said means to immobilize said elongated rod including a screw and locknut combination.

3. Tuneable means as claimed in claim 1, wherein the apex of the substantially conical concavity of said baffle leads into a manifold chamber from which radiate a plurality of spaced passageways, each inclined towards said secondary chamber, which communicate said primary chamber with said secondary chamber; and wherein a plurality of spaced, axially-oriented passageways lead off from the substantially conical concavity of said plug to thereby communicate said secondary chamber with atmosphere; said means to immobilize said elongated rod including external threads on the downstream end thereof and co-acting internal threads around the wall of the bore of said plug.

4. Tuneable means as claimed in claim 1, wherein the apex of the substantially conical concavity of said baffle communicates, via a central chamber, with the apex of a similar substantially conical concavity constituting a wave-reflecting downstream side of said baffle, said two substantially conical concavities, together with said central chamber, forming said communication conduit through said baffle; and wherein the apex of the substantially conical concavity of said plug leads into an axial passageway which communicates said secondary chamber with atmosphere; said elongated rod being positioned eccentrically with respect to the longitudinal axes of said baffle and plug, and the means to immobilize said rod including a screw and locknut combination.

5. Tuneable means for the exhaust system of a two-stroke cycle internal combustion engine, comprising a baffle slidable longitudinally within an exhaust pipe of said exhaust system; a plug insertable into the free, downstream end of said exhaust pipe; and means for selectively positioning said baffle within said exhaust pipe to thereby define therein an upstream primary chamber and a downstream secondary chamber;

said baffle having a wave-reflecting upstream side constituted by a concavity of substantially conical configuration, having a conic angle of 30°, the apex of the concavity leading into a manifold chamber from which radiate a plurality of spaced passageways, each inclined towards said secondary chamber, which communicate said primary chamber with said secondary chamber, the combined cross-sectional area of the exhaust port of the engine's manifold;

said plug having a wave-reflecting upstream side constituted by a concavity of substantially conical configuration, having a conic angle of 30°, the apex of the concavity leading into a chamber from which a passageway, inclined away from said secondary chamber, communicates said secondary chamber with atmosphere, the cross-sectional area of said passageway being 13% of the cross-sectional area of the exhaust port of the engine's manifold;

and said baffle positioning means including an elongated rod, one end of which is inserted into the apex of a substantially conical boss forming the downstream side of said baffle and the other end of which is adapted to extend through a co-acting bore extending longitudinally through said plug;

said plug being provided with screw and locknut combination means to immobilize said elongated rod in said bore to thereby immobilize said baffle at a selected location within said exhaust pipe, there being stop means on said rod to prevent said baffle from approaching said plug so closely as to inhibit exhaust discharge.

6. Tuneable means for the exhaust system of a two-stroke cycle internal combustion engine, comprising a baffle slidable longitudinally within an exhaust pipe of said exhaust system; a plug insertable into the free, downstream end of said exhaust pipe; and means for selectively positioning said baffle within said exhaust pipe to thereby define therein an upstream primary chamber and a downstream secondary chamber;

said baffle having a wave-reflecting upstream side constituted by a concavity of substantially conical configuration, having a conic angle of 30°, the apex of the concavity leading into a manifold chamber from which radiate a plurality of spaced passageways, each inclined towards said secondary chamber, which communicate said primary chamber with said secondary chamber, the combined cross-sectional areas of said four passageways being 25% of the cross-sectional area of the exhaust port of the engine's manifold;

said plug having a wave-reflecting upstream side constituted by a concavity of substantially conical configuration from which lead off a plurality of spaced, axially-oriented passageways to thereby communicate said secondary chamber with atmosphere;

and said baffle positioning means including an elongated rod, one end of which is threaded so as to be screwable into the apex of a substantially conical boss forming the downstream side of said baffle and the other end of which is adapted to extend through a co-acting bore extending longitudinally through said plug;

said plug being provided with internal threads around the wall of the bore of the plug to co-operate with external threads on the downstream end of said elongated rod, to thereby immobilize said rod in said bore and thus to immobilize said baffle at a selected location within said exhaust pipe.

* * * * *